United States Patent [19]

Cvacho et al.

[11] 4,134,354

[45] Jan. 16, 1979

[54] METHOD OF MAKING A CONTAINER

[75] Inventors: Daniel S. Cvacho; Edwin R. Haufler; Joseph W. Wallace; James M. Woolard, all of Richmond, Va.

[73] Assignee: Reynolds Metals Company, Richmond, Va.

[21] Appl. No.: 821,712

[22] Filed: Aug. 4, 1977

Related U.S. Application Data

[60] Division of Ser. No. 656,045, Feb. 6, 1976, which is a continuation of Ser. No. 487,996, Jul. 12, 1974, abandoned.

[51] Int. Cl.[2] ..... B21D 51/26

[52] U.S. Cl. ..... 113/120 H

[58] Field of Search ..... 113/116 R, 116 QA, 120 H, 113/120 M, 120 DD, 120 R; 220/66, 70

[56] References Cited

U.S. PATENT DOCUMENTS

| | | | |
|---|---|---|---|
| 2,423,708 | 7/1947 | Keogh et al. | 113/120 H |
| 3,409,167 | 11/1968 | Blanchard | 220/66 |
| 3,690,507 | 9/1972 | Gailus et al. | 220/70 |
| 3,760,751 | 9/1973 | Dunn et al. | 113/120 H |
| 3,789,785 | 2/1974 | Petit et al. | 113/120 M |
| 3,998,174 | 12/1976 | Saunders | 113/120 M |

FOREIGN PATENT DOCUMENTS

| | | | |
|---|---|---|---|
| 969114 | 6/1975 | Canada | 220/70 |

*Primary Examiner*—Michael J. Keenan

*Attorney, Agent, or Firm*—Glenn, Lyne, Gibbs & Clark

[57] ABSTRACT

A drawn and ironed easily hand-held metallic container construction is provided and has a central longitudinal axis, a sidewall, and a high-performance bottom wall. The bottom wall has a first substantially frustoconical portion adjoining the sidewall and extending downwardly and toward the longitudinal axis, a second frustoconical portion interconnected to the first frustoconical portion and extending upwardly therefrom toward the longitudinal axis. The bottom wall also has a substantially semi-torroidal inwardly convex bead adjoining the second frustoconical portion and a dished portion adjoining the semi-torroidal bead with the dished portion having a flat central part. The semi-torroidal bead improves the capability of bottom wall to withstand internal pressure while the dished portion with its flat central part is positioned at precisely controlled position based on the desired volume of the container construction and enables wear of tooling employed to make the container construction to be taken into account in determining the controlled position.

1 Claim, 7 Drawing Figures

METHOD OF MAKING A CONTAINER

This application is a division of Ser. No. 656,045 filed Feb. 6, 1976, which application is a continuation of Ser. No. 487,996 filed July 12, 1974 (now abandoned).

BACKGROUND OF THE INVENTION

Container constructions particularly of the drawn and ironed metal type which are easily held in one hand and used to contain various products, such as, carbonated beverages, paint and related products, deodorants, household sprays, and the like, under gaseous pressure are manufactured by an industry which is so highly competitive that any change in construction which will allow the use of less metal without sacrificing performance capabilities or where the construction lends itself to the utilization of tooling which by ordinary previous manufacturing standards would be considered excessively worn invariably gives the manufacturer a cost advantage.

There are numerous container constructions in present use which are produced by drawing and ironing a cup-shaped or flat metal blank into a tubular cylindrical side wall having an integral bottom wall and an open end. In many of these previously proposed container constructions the bottom wall is inwardly domed so as to provide a structural configuration that will resist the tendency of internal pressure subsequently created by a product in the resulting container construction from outwardly bowing such bottom wall. However, it has been found in the process of developing this invention that a container construction which utilized fully inwardly domed bottom walls has less volumetric capacity when considering the overall length of the side wall of such a container construction. In addition, it has been found that such a container construction with an inwardly domed bottom wall has its bottom wall placed under substantial compressive stress which causes buckling of the dome upon dropping the container and as commonly occurs when dispensing products such as carbonated beverages, for example, in automatic dispensing machines wherein the containers are routinely dropped during dispensing thereof, or an entire carton of containers is dropped during normal or routine handling.

Other container constructions in present use have bottom walls which are provided with flat central portions; however, each of these container constructions has an annular portion which adjoins its side wall and extends upwardly within the side wall volume whereby this is a departure from a more ideal situation of having that portion of the bottom wall which adjoins the side wall taper inwardly toward the longitudinal axis of the container.

SUMMARY

This invention provides a drawn and ironed easily hand-held metallic container construction capable of containing products under pressure yet which can be manufactured at minimum cost utilizing material of comparatively thin guage.

The container construction has a central longitudinal axis, a sidewall, and a high-performance bottom wall. The bottom wall has a first substantially frustoconical portion adjoining the sidewall and extending downwardly and toward the longitudinal axis, a second frustoconical portion interconnected to the first frustoconical portion and extending upwardly therefrom toward the longitudinal axis. The bottom wall also has a substantially semi-torroidal inwardly convex bead adjoining the second frustoconical portion and a dished portion adjoining the semi-torroidal bead with the dished portion having a flat central part. The semi-torroidal bead improves the capability of the bottom wall to withstand internal pressure while the dished portion with its flat central part is positioned at a precisely controlled position based on the desired volume of the container construction and enables wear of tooling employed to make the container construction to be taken into account in determining the controlled position.

Other details, uses, and advantages of this invention will become apparent as the following description of the exemplary embodiments thereof presented in the accompanying drawings proceeds.

BRIEF DESCRIPTION OF THE DRAWINGS

The accompanying drawings show present preferred embodiments of this invention, in which.

DESCRIPTION OF ILLUSTRATED EMBODIMENT

Figure 1:
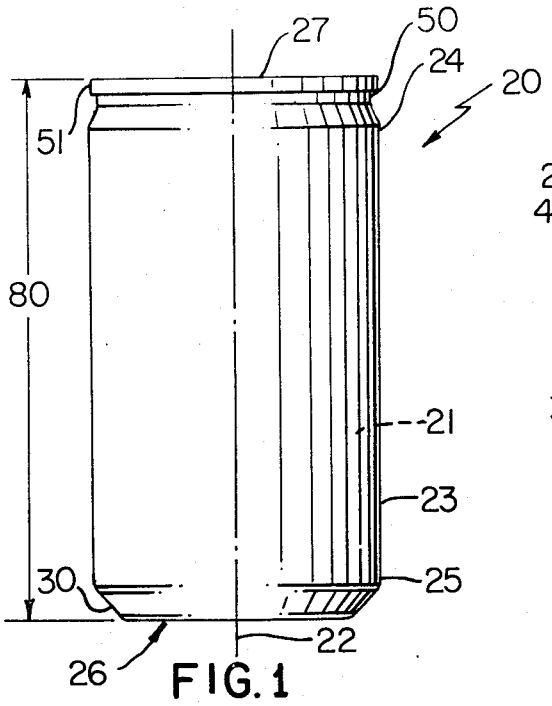
FIG. 1 is a side elevation of one exemplary embodiment of the container construction of this invention.

Reference is now made to FIG. 1 of the drawings which illustrates one exemplary embodiment of a container construction or container of this invention which is designated generally by the reference numeral 20 and is in the form of a light-weight easily hand-held container which is made by drawing and ironing of a suitable metallic material such as a ferrous material or an aluminous material, for example; and, the exemplary container construction or container 20 is used to contain a carbonated beverage 21 under gaseous pressure and at pressure levels which for a carbonated soft drink may be generally of the order of 90 psig and even greater.

The container 20 has a central longitudinal axis 22 and comprises an elongated cylindrical side wall 23 which is preferably of a right circular cylindrical tubular configuration along the main vertical height thereof and the side wall 23 has opposed ends shown as its upper or top end 24 and lower or bottom end 25. The container 20 has a bottom wall which is designated generally by the reference numeral 26 closing its lower end 25 and the bottom wall 26 and side wall 23 are preferably made as a unitary single-piece construction free of seams or the like. The container 20 also has a top wall or top closure 27 which is suitably fixed in position by any technique which is well known in the art.

Figure 3:
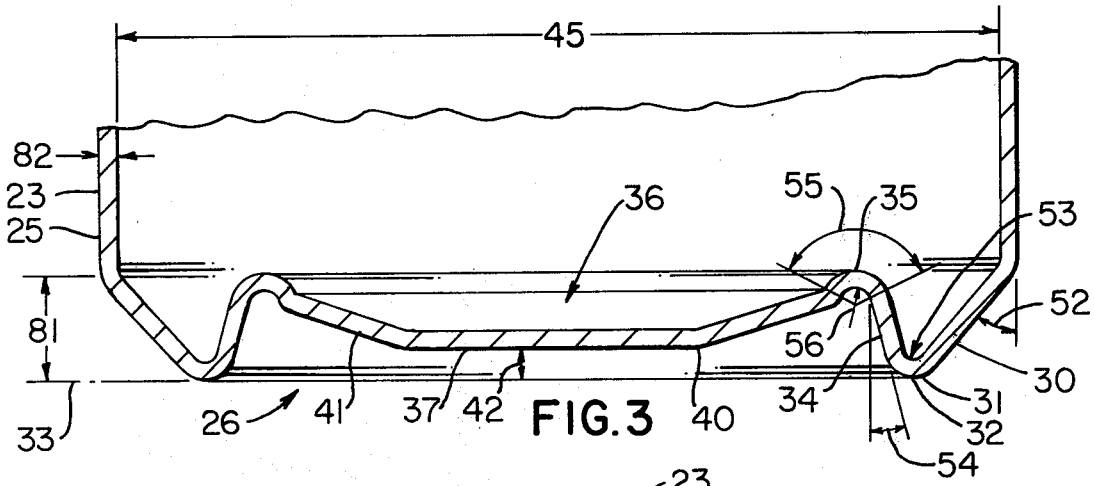
FIG. 3 is a fragmentary cross-sectional view drawn to an enlarged scale and taken on the line 3—3 of FIG. 2.

As seen particularly in FIG. 3, the bottom wall 26 has a first substantially frustoconical portion 30 adjoining its lower end 25 of the side wall 23 and extending downwardly, with the container 20 positioned as illustrated in FIG. 1, and toward the longitudinal axis 22; and, the bottom wall has an outwardly convex annular bottom bead 31 adjoining the first frustoconical portion 30 with the bottom bead 31 having a bottom supporting edge 32 arranged in a plane which is indicated by a dot-dash line and designated by the reference numeral 33.

The bottom wall 26 has a second frustoconical portion 34 adjoining the bottom bead 31 and extending upwardly therefrom toward the longitudinal axis 22; and, the bottom wall 26 also has a substantially semi-torroidal inwardly convex bead 35 adjoining the second frustoconical portion 34. The bottom wall 26 is completed by what will be described as a dished portion 36 adjoining the semi-torroidal bead with dished portion 36 having a flat central part 37.

Figure 2:
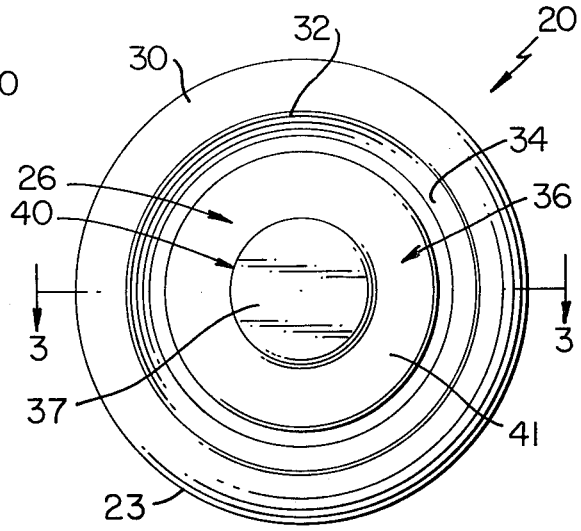
FIG. 2 is a bottom view of the container construction of FIG. 1 drawn to an enlarged scale.

In the process of making the container 20 the central part 37 is manufactured as flat as it is practical to manufacture such part and for a purpose which will be subsequently described in more detail. As best seen in FIG. 2, flat central part 37 has a circular peripheral outline, as indicated at 40, and the remainder of the dished portion 36 is in the form of a shallow substantially frustoconical portion 41 which adjoins the flat central part 37 at the circular edge 40 at its small diameter edge and adjoins the semi-torroidal bead 35 at its large diameter edge.

The semi-torroidal bead improves the capability of the bottom wall 26 to withstand internal pressure. For example, in manufacturing a typical twelve ounce container 20 and filling such container with a carbonated soft drink it was found that the semi-torroidal bead 35 increased the capability of the bottom wall 26 to withstand greater internal pressures generally of the order of 5 psig when compared with a similar container which was made without the semi-torroidal bead 35.

Figure 6:
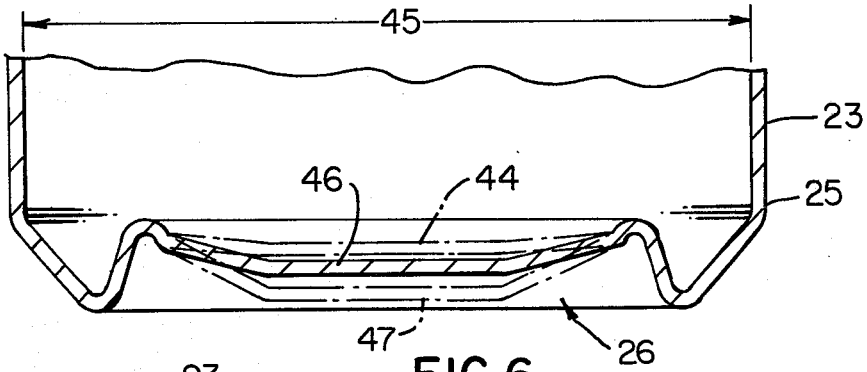
FIG. 6 is a fragmentary cross-sectional view similar to FIG. 3 particularly illustrating by solid lines one position of the flat central part of the bottom wall to provide a particular volume for the container construction utilizing partially worn tooling and illustrating by dotted lines other positions of the flat central part with the inwardly arranged dotted line position representing unworn tooling and the outwardly arranged position indicating substantially worn tooling.

The flat central part 37 is positioned a controlled distance, as indicated at 42 in FIG. 3, above the plane 33 and the distance indicated at 42 may be changed to compensate for wear in the tooling, such as a cooperating punch and die, used to make the container 20, as will be described in more detail subsequently. Thus, for a given size container and with an unworn punch of a cooperating punch and die the flat central part 37 of the bottom wall 26 may be positioned as shown at 44 in FIG. 6 of the drawing. As the punch wears and the inside diameter 45 of the container is correspondingly decreased it will be appreciated that the volume of the container is similarly correspondingly reduced whereby with the unique bottom wall 26 of this invention it is a simple matter to decrease the height 42 shown in FIG. 3 to the solid line position 46 illustrated in FIG. 6 to provide additional volume sufficient to meet customer requirements. With still further wear of the punch the precisely controlled distance 42 is reduced further to the position illustrated at 47 in FIG. 6. to provide additional volume compensating for wear and as will be explained in more detail subsequently.

As will be apparent from FIG. 1 of the drawings the upper end 24 of the side wall 23 is formed or contoured inwardly as shown at 50 so that upon suitably fixing the top closure 27 in position, the outer peripheral surface of the flange 51 of top closure 27 is arranged within the confines of an imaginary extension of the outside surface of the right circular cylindrical side wall 23.

Referring again to FIG. 3 of the drawings it will be seen that the first frustoconical portion 30 adjoining end 25 of the side wall 23 extends downwardly and toward the longitudinal axis 22 as previously mentioned. Preferably the frustoconical portion 30 always is arranged so that it extends at an angle indicated at 52 ranging between 30 and 60 degrees with the side wall 23.

The bottom bead 31 adjoining the small diameter portion of the frustoconical portion is in the form of an arcuate bead having a radius indicated at 53. The radius 53 may vary with standard manufacturing techniques, but is sufficiently generous to avoid stress concentrations which could cause metal failure.

The second frustoconical portion or frustoconical portion 34 adjoins the bottom bead 31 and is arranged at an angle indicated at 54 with the longitudinal axis 22 or the right circular cylindrical portion of the side wall 23. The angle 54 may range between 0 degrees and 15 degrees with the longitudinal axis 22.

The semi-torroidal bead 35 adjoins the second substantially frustoconical portion 34 and such bead has a substantial arcuate length, when viewed in cross section, indicated at 55 which is greater than 100 degrees and is preferably generally of the order of 180 degrees. The semi-torroidal bead also has a radius indicated at 56 which for a typical twelve ounce container may range between 0.030–0.187 inch and usually is roughly 0.060 inch whereby the semi-torroidal bead 35 has optimum structural integrity and is free of stress concentrations.

The control of the bottom wall 26 during manufacture is achieved primarily by controlling the frustoconical portions 30 and 34, bottom bead 32, semi-torroidal bead 35, and the height 42 that the flat central part 37 is arranged above the plane 33. In addition, the flat central part is manufactured as nearly flat or in one plane as it is practical to do so using die means of the character to be described subsequently.

As previously mentioned, the container 20 is preferably made by drawing and ironing and for this purpose a cooperating punch and die is employed. For example, a punch designated generally by the reference numeral 60 in FIG. 4 may be employed and used with an associated drawing ring means, not shown, to define the main portion of the cylindrical side wall 23 and the frustoconical portion 30. Control of the angle of the frustoconical portion 30 is achieved by a corresponding frustoconical surface portion 61 at the forward end of the punch 60.

Figure 4:
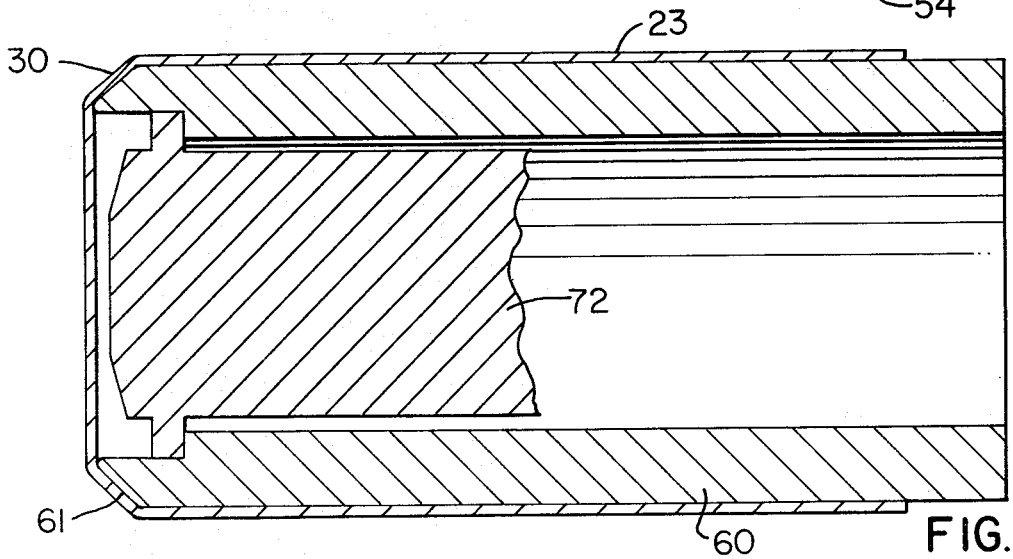
FIG. 4 is a view illustrating a punch employed in drawing and ironing the container construction of FIG. 1.
Figure 5:
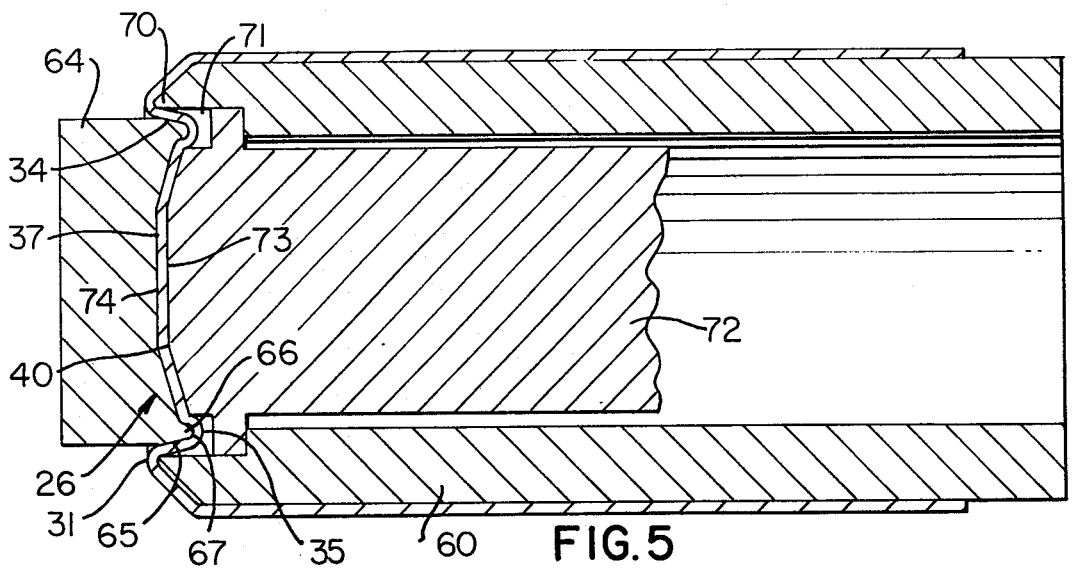
FIG. 5 is a view illustrating the punch of FIG. 4 and a cooperating die engaging the container construction to complete the forming of the bottom wall to define the configuration shown in FIG. 3.

After having partially formed an associated workpiece used to make the container construction 20 in the manner illustrated in FIG. 4, a die member 64 is used and cooperates with the punch 60 to define the remaining major portion of the bottom wall 26, see FIG. 5. The die member or die 64 has a substantially frustoconical forming surface 65 which defines the frustoconical portion 34 of the container, and, the die 64 has a beaded portion 66 which has a substantially semi-torroidal outside surface 67 which defines semi-torroidal bead 35.

The punch 60 has a projection 70 which defines the bottom bead 31 once the punch 60 and die 64 are brought into cooperating forming action and it will be seen that a substantial relief area, indicated at 71, is provided between the punch 60 with its support die 72 and the die 64. Therefore, the inwardly convex surface of the semi-torroidal bead 35 and the inside surface of the frustoconical portion 34 are defined in a unrestrained manner, inasmuch as these surfaces are located in the relief area 71.

Control of the flat central part 37 above the plane 33 and hence the bottom edge 32 of the bottom bead 31 is achieved by utilizing an outermost planar surface 73 of the support die 72 and a cooperating surface 74 of the die 64. The surfaces 73 and 74 define the flat central part 37 with its circular outer edge indicated at 40 and as previously mentioned.

The surfaces 73 and 74 are located relative to their associated dies 72 and 64 respectively so that when dies 72 and 64 are brought into cooperating engagement and with a new punch 60 and its associated drawing ring means (not shown) the flat central part 37 is arranged at the predetermined position 44 which is precisely controlled to assure provision of a given volume. As the punch 60 wears it is used with corresponding smaller diameter drawing ring means and dies 72 and 64 provided with surfaces 73 and 74 respectively located to take such wear into account whereby the container 20 first has its flat central part controlled to height 42 as shown at 44, then at 46, and then at 47 with increasing punch wear.

It will be appreciated that there is corresponding wear on the inside diameter of the drawing ring means (not shown) used with the punch 60 whereby in order to maintain a predetermined volume for a container 20 as required by a particular customer the worn drawing ring means may be matched with an unworn associated punch to provide the desired volume together with control of surfaces used to define the controlled height 42.

It has been found that with the unique shape of the bottom wall 26 in accordance with the teachings of this invention, and the simplicity with which volume adjustments can be made, it is possible to allow a punch 60 to wear as much as 0.007 inch in outside diameter under the minimum acceptable outside diameter and still provide containers having the desired volume by using die members 72 and 64 having surfaces 73 and 74 respectively which take the wear into account.

The container 20 including its side wall 23 with an integral bottom wall 26, and top closure 27 may be made of any suitable metallic material known in the art. Preferably, and as previously mentioned, the entire container is made of an aluminous material. For example, the container 20 may be made of 3004-H-19 aluminum alloy; and, for such a container having a volume of twelve ounces and being adapted for use in containing a carbonated soft drink the container should be capable of withstanding 90 psig internal pressure. The inside diameter of such an exemplary container, as indicated at 45 in FIG. 3, may be defined utilizing a punch manufactured to an outside diameter ranging between 2.580–2.584 inch. The bottom wall 26 may range in thickness between 0.011 and 0.0135 inch. The overall height of the container 20, indicated at 80, may be 4.880 inches plus or minus 0.004 inch. The height, indicated at 81 in FIG. 3, may be 0.265 inch plus or minus 0.007 inch and the wall thickness of the side wall at 82 may be 0.0056 inch plus or minus 0.002 inch. The thickness of the side wall 23 adjacent the end 24 where the side wall begins to neck in may be 0.0051 inch plus or minus 0.0002 inch.

As previously mentioned the container 20 with its improved bottom wall 26 is capable of withstanding drop tests with substantially no damage thereto and in this regard is superior to previously proposed similar containers. This capability to withstand drop tests is due in large measure to the flat central part 37 of the dished portion 36 of the bottom wall 26. The flat central part provides what is commonly referred to as an "oil can" effect whereby upon dropping a container 20 filled with a carbonated beverage, for example, there is a flexing of the flat central part 37 similar to what occurs in the typical oil can which has a long necked spout upon pressing inwardly on the bottom wall of such oil can to dispense oil therefrom. The oil can action tends to absorb shock and thus tends to minimize the amount of stress transmitted to the actual material comprising the bottom wall.

It has also been found that when a container 20 is dropped on its bottom wall as often occurs when an entire carton of such containers is dropped, for example, the flat central part 37 generally flexes outwardly and strikes its carton and simply rebounds without damage either to part 37 or to adjoining parts of the bottom wall.

The container 20 of this invention, particularly as a result of its unique bottom wall 26, has important advantages when employed to contain carbonated beverages such as beer, soft drinks, and the like. For example, the overall height of the container does not change, even if dropped, making it a more reliable structure to dispense in automatic vending machines. Also, the container 20 may be dispensed from such automatic vending machines, which customarily drop filled containers, without damage thereto.

Figure 7:
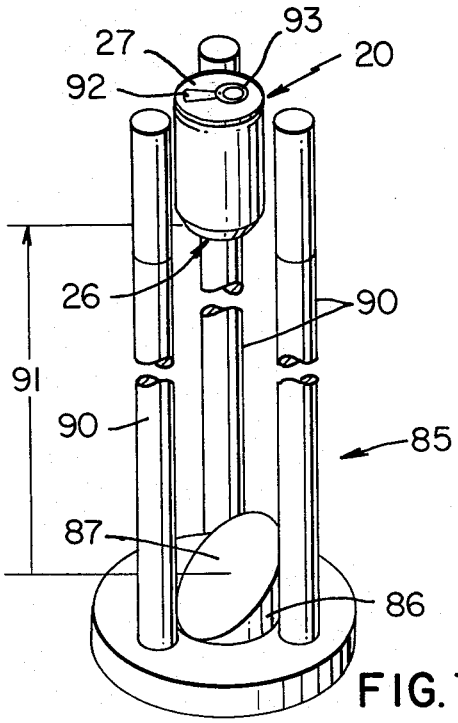
FIG. 7 is a perspective view with parts broken away particularly illustrating a test fixture of the type utilized to test the capability of containers to withstand dropping thereof.

The container 20 has been compared to other container constructions proposed heretofore; and, a test fixture for the purpose of determining the structural integrity of a particular container construction during drop tests is illustrated in FIG. 7 and designated generally by the reference numeral 85. The test fixture 85 may have an impact-absorbing member 86 which in this example is shown provided with an inclined impact surface 87 which is arranged at an angle of approximately 45 degrees with a horizontal plane; and, the fixture 85 has vertical guide rails 90 which confine the container 20 very loosely as it is dropped from a predetermined height above the impact surface. However, it will be appreciated that the member 86 may be provided with a surface 87 at any angle ranging from horizontal to near vertical. Further, a plurality of different members 86 may be provided with the fixture 85 with each member 86 having a different inclined surface.

In general, the standard test for 12 ounce beverage containers containing a beverage at 90 psig is to drop the beverage container 20 a height of 30 inches as indicated at 91 and then note the effect of this 30 inch drop on the container bottom wall. The container 20 of this invention is capable of successfully withstanding this 30 inch drop test without detrimental results.

The top wall or top closure 27 may be of any suitable construction and may have a severable section 92 which in this example is provided with a pull ring 93. However, it will be appreciated that the top closure 27 for the container 20 may have a severable section which is pushed within the container 20 over the major periphery of the section 92 yet remains attached to the top wall 27. In addition, the top wall may be without any severable section therein and may be of the type which is opened by a separate opener, or the like.

While present exemplary embodiments of this invention, and methods of practicing the same, have been illustrated and described, it will be recognized that this invention may be otherwise variously embodied and practiced within the scope of the following claims.

We claim:

1. A method of making a series of drawn and ironed easily hand-held metallic containers of the type having a central longitudinal axis and comprising a side wall which has opposed ends and a bottom wall closing one of said opposed ends, said bottom wall having a first portion adjoining said one end and extending inwardly toward said longitudinal axis, and a second portion adjoining said first portion and adapted to have the location thereof adjusted relative to said central longitudinal axis, said method comprising the steps of:

drawing and ironing a first such metallic container by means of a first cooperating punch and die;

forming said bottom wall of said first metallic container by means of a first supplemental die to adjust the location of said second portion to obtain a given volume of said container;

forming additional such containers in accordance with the above defined steps, but permitting the volume of said additional containers to vary from said given volume by a predetermined amount of said cooperating punch and die wear; and, readjusting the location of said second portion of subsequent containers to a second location to again obtain said given volume in said subsequent containers, whereby the volume of said containers can be maintained within desired limits without replacing said cooperating punch and die because of wear thereof.

* * * * *